United States Patent [19]

Chen

[11] Patent Number: 4,590,543

[45] Date of Patent: May 20, 1986

[54] TRILIGHT

[75] Inventor: Grand Chen, Ban-Chiau, Taiwan

[73] Assignee: Silver River Electronic Co., Ltd., Taiwan

[21] Appl. No.: 668,153

[22] Filed: Nov. 5, 1984

[51] Int. Cl.[4] ..... F21L 7/00

[52] U.S. Cl. ..... 362/183; 362/191; 362/269; 362/368; 362/166

[58] Field of Search ..... 362/183, 191, 199, 198, 362/197, 269, 274, 285, 287, 288, 370, 368, 428, 166, 230, 231

[56] References Cited

U.S. PATENT DOCUMENTS

| | | | |
|---|---|---|---|
| 2,539,974 | 1/1951 | Riddell | 362/199 |
| 3,032,641 | 5/1962 | Deputy | 362/231 |
| 3,233,092 | 2/1966 | Umholtz | 362/183 |
| 3,641,336 | 2/1972 | Boin | 362/183 |
| 3,829,679 | 8/1974 | Rogers | 362/269 |
| 3,908,179 | 9/1975 | Heehler et al. | 362/231 |
| 4,345,304 | 8/1982 | Penney et al. | 362/191 |
| 4,414,611 | 11/1983 | Seltzer et al. | 362/191 |
| 4,438,483 | 3/1984 | Gulliksen et al. | 362/183 |
| 4,459,646 | 7/1984 | Drane | 362/199 |

*Primary Examiner*—Magdalen Y. C. Moy

[57] ABSTRACT

A trilite characterized by comprising a case with a pivoted head, a separable wall holder, a circuit board and other components wherein the light head and body are pivoted together with two pivots and the circuit board has two rechargeable batteries and a CDS so that the ambient illumination will control the illumination of the bulb and the trilite will function as night light, emergency light and spot light.

3 Claims, 4 Drawing Figures

TRILIGHT

SUMMARY OF THE INVENTION

This invention relates to a trilite characterized by comprising such main components as a case with an adjustable head, a detachable wall holder with a rectifier and a circuit board, and functioning as night light, emergency light and spot light. When used as a night light, the darkness will make the illumination of the bulb increase automatically to the lux one half of full illumination.

In case of power failure the emergency light will work automatically with the input power from DC adaptor. After the hold is removed, it can be used as a flashlight.

DESCRIPTION OF THE PREFERRED EMBODIMENT

Figure 1:
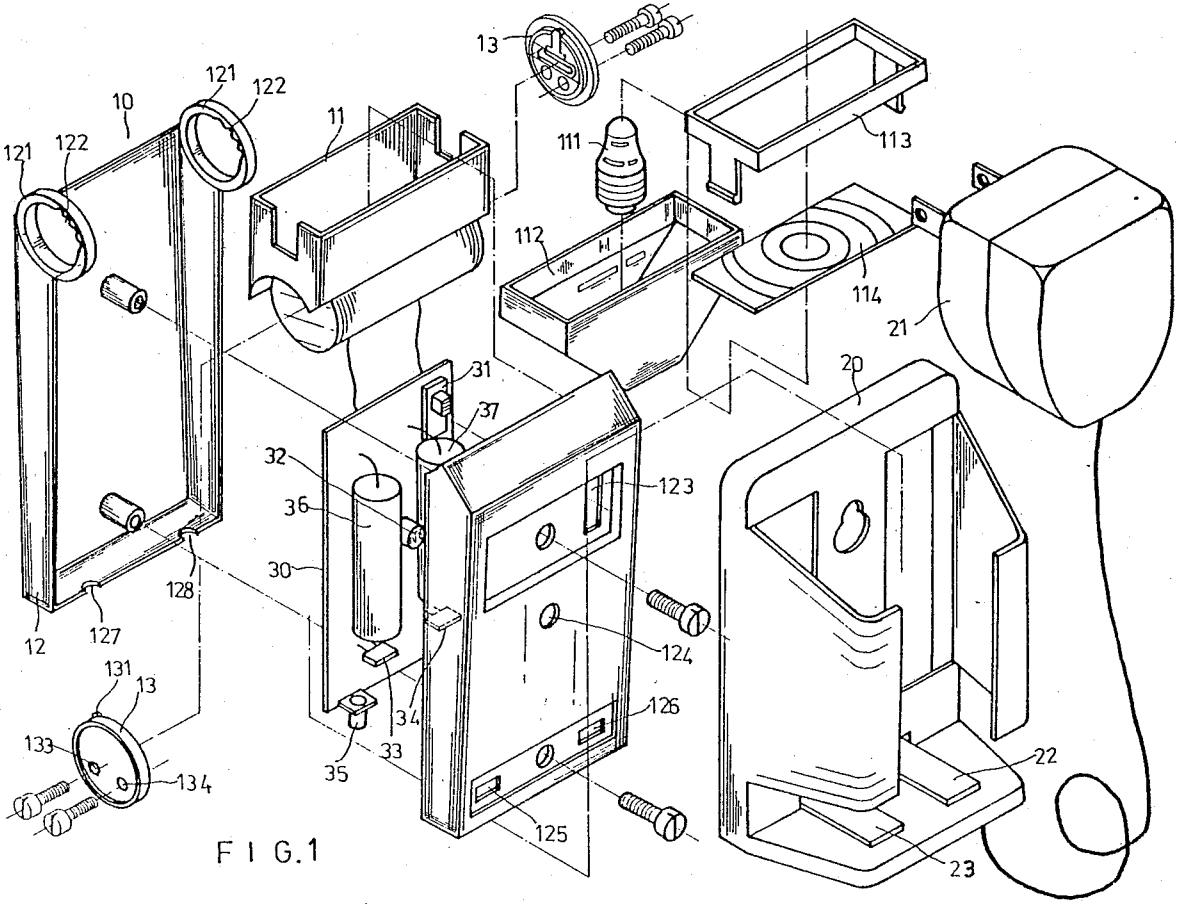
FIG. 1 is a vertical sectional view of the trilite of this invention.

Generally, electric lights are either stationary or portable. Stationary lights are usually fixed to the wall or ceiling and lighted with the input power from the AC adaptor. While portable lights are lighted with the input power from DC adaptor. But it is very rare to combine both stationary and portable light in one unit. From the necessity, electric lights can be divided into two kinds: one for normal use, or for use when the power supply is normal and the other for emergency use, or for use during power failure. It is ideal to have one electric light which is capable of both normal and emergency use and which is both stationary and portable. To meet this requirement the inventor developed the trilite of this invention. So the object of this invention is to provide a trilite which can meet the said requirement.

Figure 2:
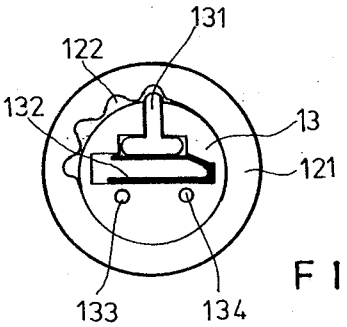
FIG. 2 is a detail of the pivot of the light head of this invention.

Referring now to the drawings the nature of this invention is described as follows:

As shown in FIG. 1 the trilite of this invention consists of a case 10, a wall holder 20 and a rectifier 21, a circuit board 30 and some other components. The case 10 has a head 11 and a body 12 pivoted together with two pivots 13. The light head 11 further consists of a bulb 111, a reflector shade 112, a shade cover 113, and a glass lens 114. The body 12 has a ring pivot bearing 121 on each of the two top sides. The ring pivot bearing 121 has several positioning grooves 122 in one port of the internal wall. The body 12 also has a switch opening 123, a CDS induction hole 124, two LED openings 125, 126 and two charging pin holes 127, 128. The pivot 13 as shown in FIG. 2 has a retractable bolt 131 and a spring 132. When the pivot 13 is fixed to the light head 11 with two screws 133, 134, the retractable bolt 131 is pushed forward by the spring 132 and against one of the inside positioning grooves 122 of the ring bearing 121 in such way that the bolt will retract and the pivot will turn as a certain force is applied.

Fitted in the body 10 is a circuit board 30 on which the switch 31, CDS 32, LEDs 33, 34 and charging pins 35 are in the holes or openings provided in the body for that purpose respectively. Also in the body 10 are two rechargeable batteries 36, 37. The separable wall holder 20 which can be hung on the wall has two contact springs 22, 23.

Figure 3:
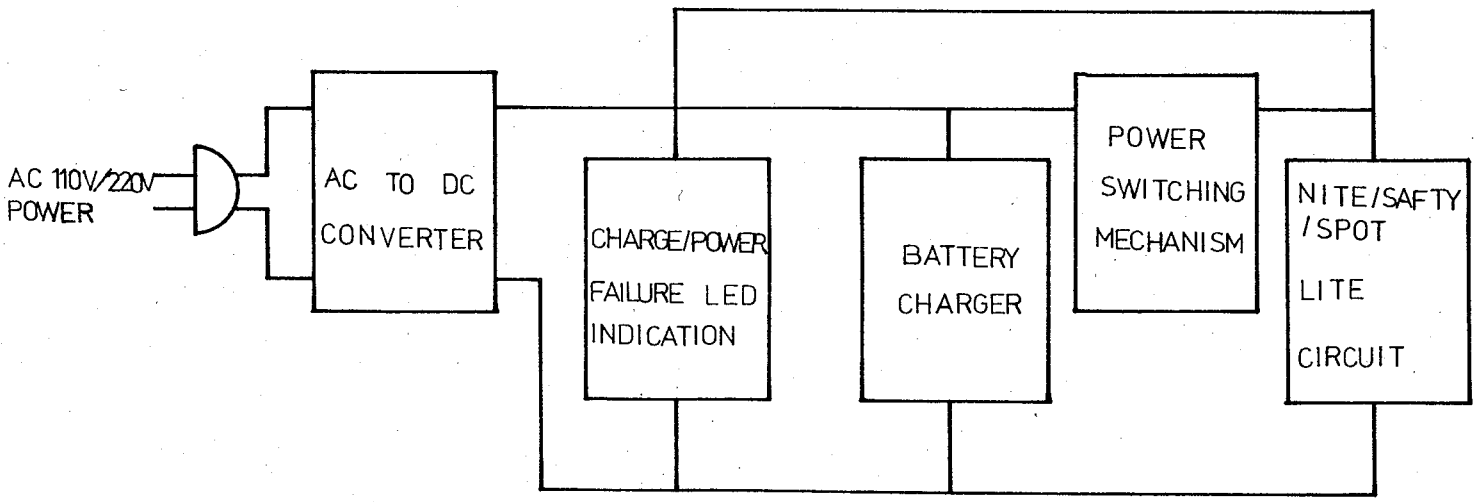
FIG. 3 is a block diagram of the trilite of this invention.
Figure 4:
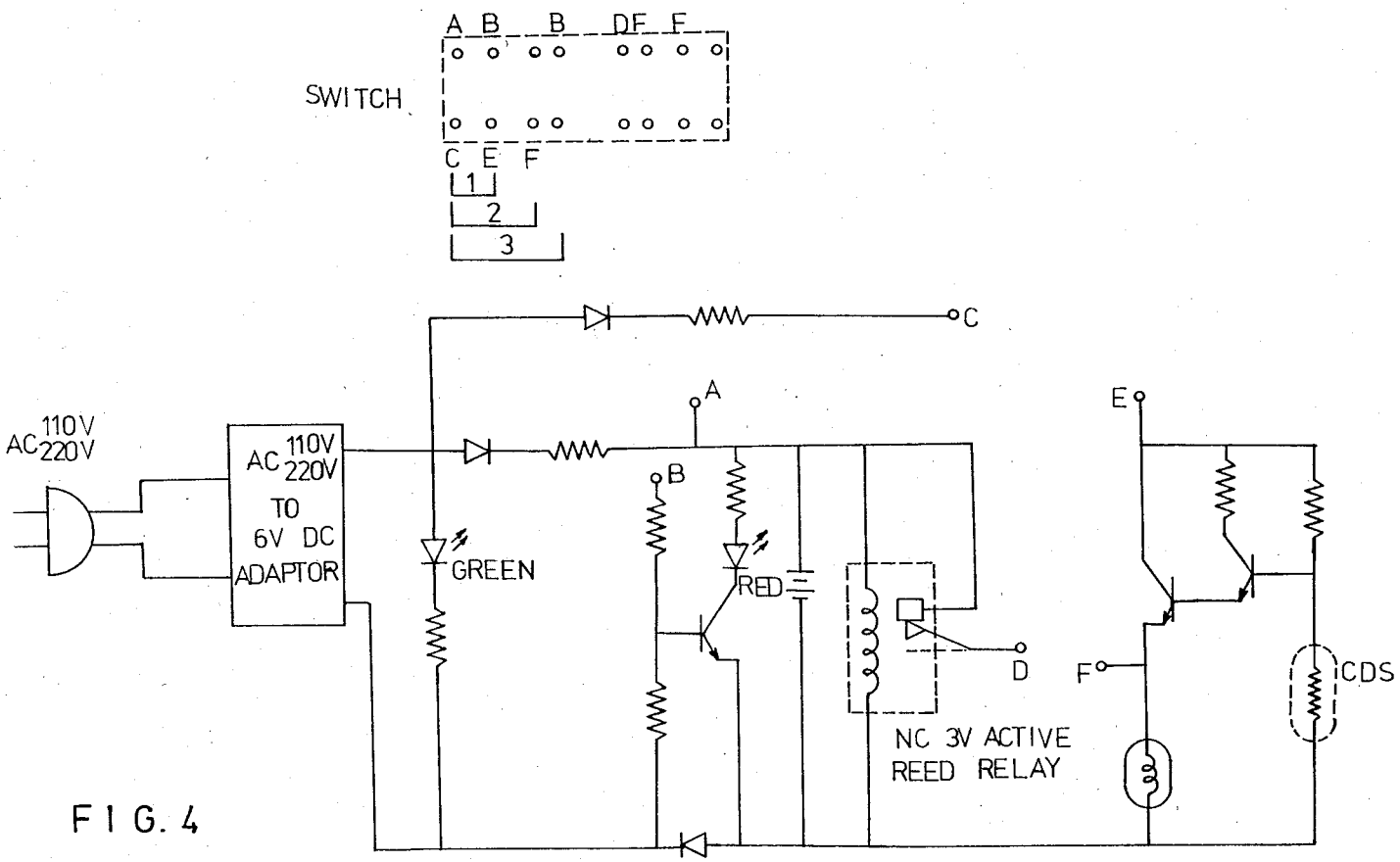
FIG. 4 is a circuit diagram of the trilite of this invention.

As shown in FIG. 3 and FIG. 4, when the switch 31 is set in the first position for night light and emergency light and the body 10 is fitted in the wall holder 20, the input power from AC adaptor will light the bulb 111 and charge the rechargeable batteries 36, 37. At this time the green LED 33 will light to indicate charging. The bulb 111 will begin to light when the ambient illumination is less than 30 lux and its illumination will increase to the lux one half of full illumination—the highest illumination of the night light—when the ambient illumination is less than 5 lux. Upon a sudden power failure, the bulb 111 will be lighted by the input power from the DC adaptor and the red LED 34 indicating power failure will light up.

When the switch 31 is set in the second position for spot light and the body 10 is fitted in the wall holder 20, the input power from the AC adaptor will not light the night light but charge the rechargeable batteries which keep the bulb 111 lighting at the lux one half of full illumination. At this time the green LED 33 lights up. If the bulb 111 lights at the lux of full illumination, the red LED 34 will light up. When the body 10 is taken off the wall holder 20 used as a flashlight, the input power from the DC adaptor will light the bulb 111 at the lux of full illumination and the red LED 34 will light up.

When the switch 31 is set in the third position, the input power from the AC adaptor will keep charging the batteries 36, 37 but the bulb 111 will not light whether the power is on or off. At this time the two LEDs 33, 34 will light up to indicate "charging" or "power failure". Of course, the red LED 34 is lighted by the input power from the DC adaptor when the AC power supply fails.

From the above, it is seen that the circuit of this invention can provide for three kinds of lights and the pivoted light heat 11 can be adjusted in four angles of 0°, 30°, 60°, and 90°, to facilitate illumination.

I claim:

1. A trilight operable as a night light, an emergency light and a spotlight, comprising a case consisting of a body and a head pivoted together by two pivots, a separable wall holder having a rectifier and contact springs, a circuit board and a spotlight, the case having two ring pivot bearings with inside grooves, the circuit board consisting of three diodes, two LEDs, seven resistors, three transistors, two rechargeable batteries, one reed relay, one CDS, one bulb, one switch having a first position, a second position and a third position, and two pins for connecting to said contact springs of the wall holder to form a circuit so that the trilight will operate as a night light and an emergency light when said switch is set in said first position, so that the trilight will operate as a spot light when said switch is set in said second position, and so that said batteries will only be charged when said switch is set in said third position.

2. A trilight operable as a night light, an emergency light, and a spotlight, comprising a case with a pivoted head, a separable charger holder and a circuit; said separable charger holder having an AC adaptor and two contact springs; said circuit having three diodes, two LEDs, seven resistors, three transistors, two rechargeable batteries, a reed relay, a CDS, a bulb, a switch and two pins; said pins being connected to the charger holder; said circuit having the function of a sensor night light through the connection of said transistors and said CDS into an induction control.

3. A trilight according to claim 2 wherein said head and said case are connected with two pivots each with a retractable bolt and spring set in both sides of said head and two ring pivot bearings at both sides of said case with several positioning grooves for said bolts pushed by said springs to set on the same plane.

* * * * *